US007213643B2

(12) United States Patent
Chen et al.

(10) Patent No.: US 7,213,643 B2
(45) Date of Patent: May 8, 2007

(54) EXPANDED LINER SYSTEM AND METHOD

(75) Inventors: Chen-Kang D. Chen, Houston, TX (US); Daniel D. Gleitman, Houston, TX (US); M. Vikram Rao, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 261 days.

(21) Appl. No.: 10/421,135

(22) Filed: Apr. 23, 2003

(65) Prior Publication Data

US 2004/0211570 A1 Oct. 28, 2004

(51) Int. Cl.
*E21B 23/00* (2006.01)
*E21B 7/00* (2006.01)

(52) U.S. Cl. ..... 166/207; 166/382; 166/384; 175/61; 175/73; 175/76

(58) Field of Classification Search ..... 166/206, 166/207, 382, 384; 175/61, 73, 76
See application file for complete search history.

(56) References Cited

U.S. PATENT DOCUMENTS

| | | | | |
|---|---|---|---|---|
| 3,179,168 | A | 4/1965 | Vincent et al. | |
| 3,245,471 | A | 4/1966 | Howard | |
| 3,358,760 | A | 12/1967 | Blagg | |
| 5,366,012 | A | 11/1994 | Lohbeck et al. | |
| 5,390,742 | A | 2/1995 | Dines et al. | |
| 5,667,011 | A | 9/1997 | Gill et al. | |
| 5,785,120 | A | 7/1998 | Smalley et al. | |
| 6,021,850 | A | 2/2000 | Wood et al. | |
| 6,050,341 | A | 4/2000 | Metcalf | |
| 6,059,051 | A * | 5/2000 | Jewkes et al. | 175/76 |
| 6,250,385 | B1 | 6/2001 | Montaron | |
| 6,269,892 | B1 * | 8/2001 | Boulton et al. | 175/61 |
| 6,457,532 | B1 * | 10/2002 | Simpson | 166/380 |
| 6,470,977 | B1 | 10/2002 | Chen et al. | |
| 6,581,699 | B1 | 6/2003 | Chen et al. | |
| 6,695,067 | B2 * | 2/2004 | Johnson et al. | 166/387 |
| 6,705,413 | B1 * | 3/2004 | Tessari | 175/22 |

(Continued)

OTHER PUBLICATIONS

Andrei Fillippov, Robert Mack, Shell; Lance Cook, Patrick York, Lev ring, Enventure Global Technology; Terry McCoy, Halliburton Energy Serivices, SPE 56500, Expander Tubular Solutions, Oct. 3-6, 1999.

(Continued)

*Primary Examiner*—Jennifer H. Gay
*Assistant Examiner*—G. M. Collins
(74) *Attorney, Agent, or Firm*—Browning Bushman P.C.

(57) ABSTRACT

A borehole may be drilled utilizing the bottom hole assembly 10, 50 with a downhole motor 14, which may offset at a selected bend angle. A gauge section 34 is secured to the bit 16 has a uniform diameter bearing surface along an axial length of at least 60% of the bit diameter. The axial spacing between the bend and the bit face is controlled to less than fifteen times the bit diameter. After drilling a section of the well with the BHA according to the present invention, a tubular may be inserted in the well by passing the tubular through an upper tubular, then the inserted tubular expanded while downhole to a diameter substantially equal to the expanded tubular.

73 Claims, 4 Drawing Sheets

U.S. PATENT DOCUMENTS

2002/0166664 A1* 11/2002 Lauritzen et al. ..... 166/277

OTHER PUBLICATIONS

Chan L. Daigle,SPE, Enventure Global Technology; Donald B. Campo, SPE, Shell Exploration & Production; Carey J. Naquin, SPE, Enventure, Halliburton Energy Services; Rudy Cardenas, Occidental Permian,Ltd.; Lev M. Ring, Patrick L. York, SPE, Enventure Global Technology, SPE 62958, Expandable Tubulars: Field Examples of Application in Well Construction and Remediation, Oct. 1-4, 2000.

Rune Gusevik and Randy Merritt, Enventure Global Technogloy L.L.C., SPE 77612, Reaching Deep Reservoir Using Solid Expanding Tubulars, Sep. 29-Oct. 2, 2002.

Norlizah Mohd Nor, Edmund Huang, Chin hon -Voon, Shell Malaysia E & P, SPE 77940, Transforming Conventional Wells in Mature Basins to Modern Bigbore Producers by Applying Solid Expandable Tubulars (SET), Oct. 8-10, 2002.

* cited by examiner

EXPANDED LINER SYSTEM AND METHOD

FIELD OF THE INVENTION

The present invention relates to technology for drilling an oil or gas well with a casing string expanded while downhole in the well. More particularly, the present invention relates to techniques for improving the efficiency of an expanded casing or liner system, with improved well quality providing for enhanced hydrocarbon recovery, and with the technology allowing for significantly reduced costs to reliably complete the well.

BACKGROUND OF THE INVENTION

Most hydrocarbon wells are drilled in successively lower casing sections, with a selected size casing run in a drilled section prior to drilling the next lower smaller diameter section of the well, then running in a reduced diameter casing size in the lower section of the well. The depth of each drilled section is thus a function of (1) the operator's desire to continue drilling as deep as possible prior to stopping the drilling operation and inserting the casing in the drilled section, (2) the risk that upper formations will be damaged by high pressure fluid required to obtain the desired well balance and downhole fluid pressure at greater depths, and (3) the risk that a portion of the drilled well may collapse or otherwise prevent the casing from being run in the well, or that the casing will become stuck in the well or otherwise practically be prevented from being run to the desired depth in a well. A significant cost of drilling and completing of the well involves the use of increased diameter sections moving upward from the total depth (TD) to the surface. From the standpoint of fluid flow, a 7⅝ inch casing near the total depth may be sufficient to transmit the desired fluids to the surface through a production tubing string, but the size of the outside casing increases from 7⅝ inches to, e.g., 17½ inches, in order that each upper section of casing be able to accommodate the small diameter sections which are run in the well.

To avoid the above problems, various techniques have been proposed for expanding a casing string downhole, in some applications so that the expanded diameter casing string has an internal diameter approximately equal to the internal diameter of the "full bore" casing string through which the smaller diameter tubular passed before being expanded while downhole. Thus in some proposed applications, substantially the entirety of a casing string from TD to surface may be substantially the same "full bore" diameter, so that, for example, if a 7⅝ inch casing ID is installed at the surface, a smaller diameter casing may be passed through the 7⅝ inch casing, which typically may be cemented in the well, and the smaller diameter casing then expanded downhole to 7⅝ inch ID casing. Successively lower sections of the well similarly may be completed by passing the smaller diameter casing downhole of a cemented 7⅝ inch casing section, then expanding the tubular while downhole to continue the 7⅝ inch casing run. In other applications, only a portion of the tubular need be expanded downhole to this "full bore" diameter to obtain the benefits for this technology. U.S. Pat. Nos. 5,348,095, 5,366,012 and 5,667,011 to Shell Oil Company disclose casing expansion techniques, as do early U.S. Pat. Nos. 3,179,168, 3,245,471 and 3,358,760. U.S. Pat. Nos. 6,021,850, 6,050,341, 5,390,742, 5,785,120 and 6,250,385, as well as publication U.S. 2001/002053241, disclose various types of equipment for expanding a downhole tubular in a well. SPE Papers 56500, 62958, 77612 and 77940, and Offshore January 2003, pp. 62, 64, discuss the commercial advantages of downhole casing expansions in terms of lower well completion costs.

Problems have nevertheless limited the acceptance of casing systems expanded downhole, including difficulties associated with the reliability and cost of expanding the tubular downhole. In most applications, the drilling operator must run a caliper through the drilled borehole to determine the borehole geometry and thereby determine if the borehole has, for example, too great of a spiral to initially run the tubular in the borehole prior to the expansion operation.

The disadvantages of the prior art are overcome by the present invention, and an improved expanded casing (or other tubular) system and method are hereinafter disclosed which will result in lower costs for drilling and completing a well, and improved well quality for enhanced hydrocarbon recovery.

SUMMARY OF THE INVENTION

The present invention in a preferred embodiment provides an expanded casing or liner system wherein a well is drilled utilizing a bottom hole assembly at the lower end of a drill string and a downhole motor with a selected bend angle, such that the bit when rotated by the motor has an axis offset at a selected bend angle from the axis of the power section of the motor. The bit may cut a hole with a larger diameter than the I.D. of a casing or other tubular in an upper portion of the well, with that tubular also optionally being expanded downhole. According to one embodiment of the invention, the motor housing may be "slick," meaning that the motor housing has a substantially uniform diameter outer surface extending axially from the upper power section to the lower bearing section. A gauge section is provided secured to the pilot bit, and has a uniform diameter surface thereon along an axial length of at least about 60% of the bit diameter. Because the hole is drilled relatively true utilizing a bottom hole assembly (BHA) of the present invention, the larger diameter tubular may be more easily and reliably slid in the drilled hole compared to systems using prior art BHAs. The tubular is expanded while downhole such that its ID increases from a run-in diameter to an expanded or set diameter.

It is thus an object of the present invention to provide an improved method of positioning a tubular in a borehole utilizing a bottom hole assembly including a fluid powered motor and a relatively long gauge section. The casing or other tubular run in the well is expanded downhole using solid expanded tubular (SET) technology.

It is a feature of the invention that the bit may be rotated by the drill string to drill a relatively straight section of the wellbore, and that the downhole motor may be powered to rotate the bit with respect to the non-rotating drill string to drill a deviated portion of the wellbore. Drilling operations may be performed with the improved bottom hole assembly to significantly reduce the costs of a drilling operation.

Another feature of the invention is that the gauge section secured to the pilot bit may have an axial length of at least 60% of the bit diameter.

Yet another feature of the invention is that the interconnection between the downhole motor and the bit is preferably accomplished with a pin connection at the lower end of the downhole motor and a box connection at the upper end of the bit.

An advantage of the present invention is that the bottom hole assembly does not require especially made components. Each of the components of the bottom hole assembly may be selected by the operator as desired to achieve the objectives of the invention.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
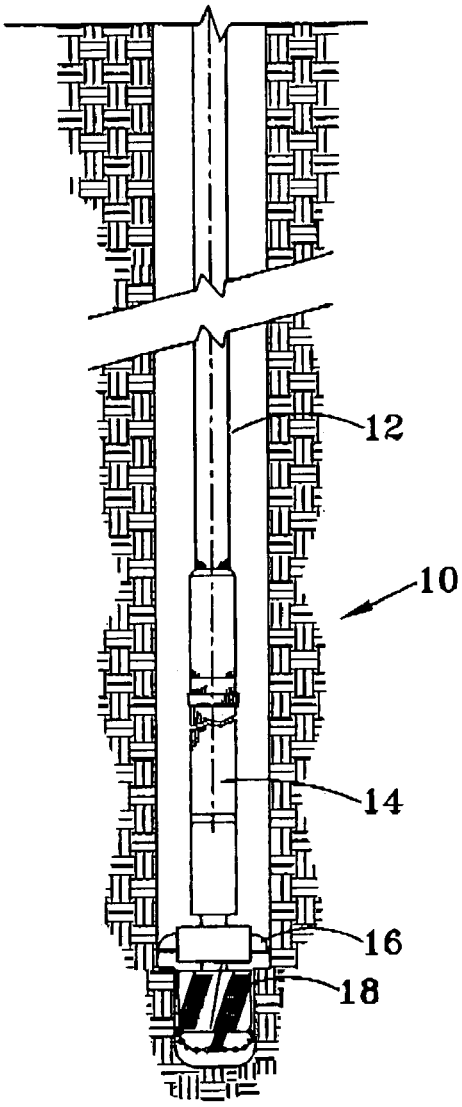
FIG. 1 generally illustrates a well drilled with a bottom hole assembly at the lower end of a drill string and a downhole motor with a pilot bit and reamer.

FIG. 1 generally illustrates a well drilled with a bottom hole assembly (BHA) 10 at the lower end of a drill string 12. The BHA 10 includes a fluid powered downhole motor 14 with a bend for rotating a pilot bit 18 and reamer 16 to drill a deviated portion of the well. A straight section of the well may be drilled by additionally rotating the drill string 12 at the surface to rotate the pilot bit 18 and reamer 16. To drill a curved section of the borehole, the drill string is slid (non-rotating) and the downhole motor 14 rotates the pilot bit 18 and reamer 16. It is generally desirable to rotate the drill string to minimize the likelihood of the drill string becoming stuck in the borehole, and to improve return of cuttings to the surface. In one embodiment, the BHA includes a positive displacement motor (PDM) and the PDM housing has a bend angle of less than about 3 degrees.

Figure 2:
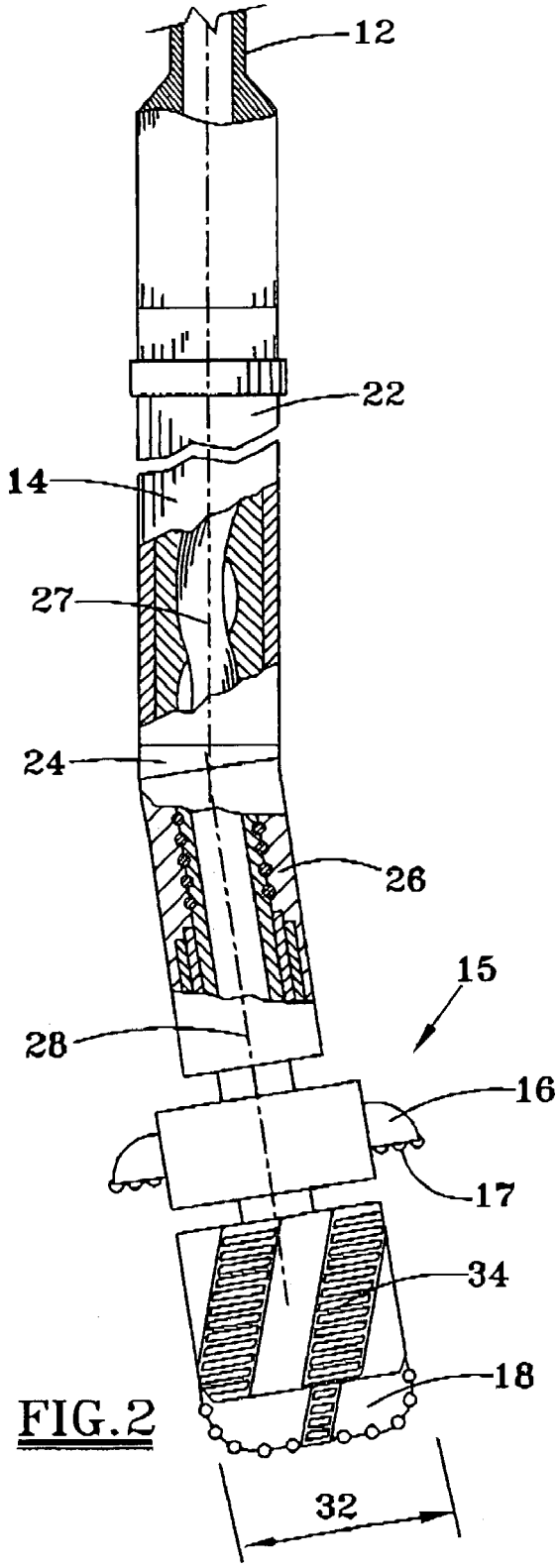
FIG. 2 illustrates the motor shown in FIG. 1 in greater detail.

The downhole motor 14 may be run "slick," meaning that the motor housing has a substantially uniform diameter from the upper power section 22 through the bend 24 and to the lower bearing section 26, as shown in FIG. 2. No stabilizers need be provided on the motor housing, since neither the motor housing nor a small diameter stabilizer is likely to engage the borehole wall due to the enlarged diameter borehole formed by the pilot bit 18 and reamer 16. The motor housing may include a slide or wear pad. A downhole motor which utilizes a lobed rotor is usually referred to as a positive displacement motor (PDM). The BHA alternatively may include a rotary steerable assembly (RSA) rather than a PDM. The PDM conventionally has a bend in its housing, while the RSA housing has no external bend, but instead has an internal bend. Also, a rotary steerable device or RSA is technically not a motor, since the bit is rotated by rotating the drill string at the surface. It is, however, a downhole motor in the sense that it replaces the PDM and serves the function of providing an effective bend angle. In either case, the term "downhole motor" as herein includes a PDM or an RSA, and the downhole motor has an upper section (power section of a PDM or shaft guide section of an RSA) central axis and a lower bearing section with a central axis offset at a selected bend angle from the upper section central axis. The borehole drilled to receive the downhole tubular may be drilled with conventional drill pipe and then the tubular inserted and expanded downhole. Alternatively, the borehole may be drilled with a casing drilling operation, so that the downhole tubular is in the well when total depth (TD) is reached.

The downhole motor 14 as shown in FIG. 2 has a bend 24 between the upper power section axis 27 and a lower bearing section axis 28 in the motor housing, so that the axis for the pilot bit 18 is offset at a selected bend angle from the axis of the lower end of the casing string. The lower bearing section 26 includes a bearing package assembly which conventionally comprises both thrust and radial bearings.

It is understood that the term "bit assembly" as used herein includes the cutting structure which is rotated to remove the rock and create the borehole. The bit assembly 15 below the gauge section as shown in FIG. 2 includes a pilot bit 18 and a reamer 16 having an end face 17 which is bounded by and defines a bit cutting diameter. The bit cutting diameter is the diameter of the hole being drilled, and thus the radially outermost cutter's final location defines the bit cutting diameter. In embodiments in which a reamer is not required and the bit is comprised solely of the gauge section and the cutting structure, then the bit cutting diameter is defined by the bit's radially outermost cutting diameter, and the bit assembly comprises an upper gauge section and a lower pilot bit or bit. In an application wherein the casing or other tubular which is run in the borehole is subsequently expanded to have an inside diameter substantially equal to an internal diameter of the tubular immediately above the expanded tubular, the bit assembly may include an upper offset cutting element of a bi-center bit with an enlarged cutting diameter, a reduced diameter gauge section in the middle, and a lower pilot bit. A more preferred combination may include an upper reamer 16, which has the enlarged cutting diameter, and a reduced diameter middle gauge section 34 and lower pilot bit 18, as shown in FIG. 2, so that the diameter of the cut borehole is greater than the interior diameter of the upper casing in the well through which the retracted reamer, gauge section and pilot bit have passed. The diameter of the borehole being drilled for the expanded tubular should not be excessive, however, since too high a gap between the OD of the expanded tubular and the borehole wall generally represents an excessive cost and energy applied in rock removal, and the gap is conventionally filled with cement. For applications wherein the downhole tubular is expanded to a diameter less than the internal diameter of the casing string above the expanded tubular, a less expensive (i.e., lesser diameter) reamer or bi-center bit may cut a reduced diameter borehole. In some of these latter applications, a standard bit (i.e., bit without reamer) and a gauge section alone may be sufficient to drill the borehole for insertion of the tubular to be expanded.

The gauge section 34 is spaced above the pilot bit 18, and is rotatably secured to and/or may be integral with the pilot bit 18. The axial length of the gauge section ("gauge length") is at least 60% of the pilot bit diameter, preferably is at least 75% of the pilot bit diameter, and in many applications may be from 90% to one and one-half times the pilot bit diameter. The significance of the axial length of the gauge section is thus a function of the diameter of the cutting structure below the gauge section, regardless of whether an enlarged bore is subsequently formed above the gauge section, or whether that enlarged hole is formed by a bi-center bit or by a reamer. In a preferred embodiment, the bottom of the gauge section may be substantially at the same axial position as the bit face, but could be spaced slightly upward from the pilot bit face. The diameter of the gauge section may be slightly undergauge with respect to the pilot bit diameter.

The axial length of the gauge section is measured from the top of the gauge section to the forward cutting structure of the pilot bit at the lowest point of the full diameter of the pilot bit, e.g., from the top of the gauge section to the pilot bit cutting face. Preferably, no less than 50% of this gauge length forms the substantially uniform diameter cylindrical bearing surface when rotating with the pilot bit. One or more short gaps or undergauge portions may thus be provided between the top of the gauge section and the bottom of the gauge section. The axial spacing between the top of the gauge section and the pilot bit face will be the total gauge length, and that portion which has a substantially uniform diameter rotating cylindrical bearing surface preferably is no less than about 50% of the total gauge length. Those skilled in the art will appreciate that the outer surface of the gauge section need not be cylindrical, and instead the gauge section is commonly provided with axially extending flutes along its length, which are typically provided in a spiral pattern. In that embodiment, the gauge section thus has uniform diameter cylindrical bearing surface defined by the uniform diameter cutters on the flutes which form the cylindrical bearing surface. The gauge section may thus have steps or flutes, but the gauge section nevertheless defines a rotating cylindrical bearing surface. The pilot bit 18 and/or reamer 16 may alternatively use roller cones rather than fixed cutters.

FIG. 2 shows a suitable pilot bit 18 having a cutting diameter 32. Rotatably fixed to the pilot bit 18 is a gauge section 34 which has a uniform surface thereon providing a uniform diameter cylindrical bearing surface along an axial length of at least 60% of the pilot bit diameter, so that the gauge section and pilot bit 18 together form a long gauge pilot bit. As noted above, the gauge section preferably is integral with the pilot bit, but the gauge section may be formed separate from the pilot bit then rotatably secured to the pilot bit. The pilot bit 18 may thus be structurally integral with the gauge section 34, or the gauge section may be formed separate from then rotatably secured to the pilot bit.

Figure 7:
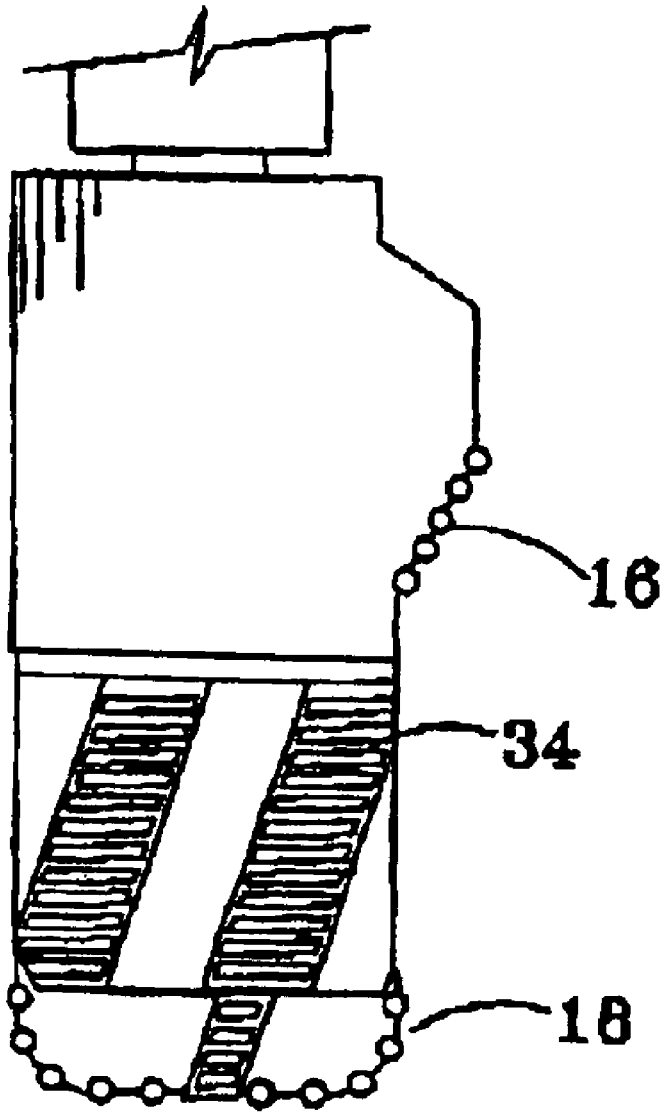
FIG. 7 illustrates a bi-centered culling bit with an offset cutting element.

FIG. 2 also depicts a reamer 16 which may be rotatably secured to the pilot bit when a hole size is required to be larger than the inner diameter of the upper tubular. The reamer has arms which may be extended following the reamer's passage through the upper tubular so that the reamer's end face 17 and associated cutters extend to a diameter greater than that of the upper tubular. Alternatively, in circumstances requiring a larger size hole than the upper tubular inner diameter, a bi-centered bit may be used below the downhole motor. The offset cutting element of the bi-centered bit may be used with a pilot bit and a gauge section as disclosed herein, with the cutting structure of the offset element above the gauge section to serve the hole-enlarging function in a similar manner to the reamer's extended arm end face. FIG. 7 depicts a bi-centered bit with offset cutting elements. The bi-centered bit 16 may be integral with or formed separately from then secured to the gauge section 34.

Figure 3:
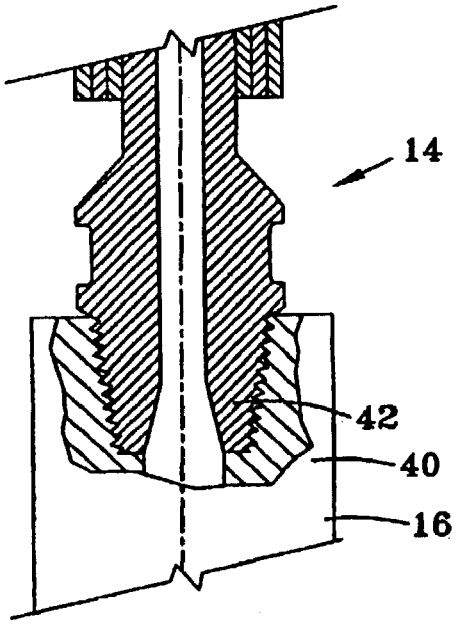
FIG. 3 illustrates a box connection on the bit connected with a pin connection on the motor.

A box connection 40 may be provided on the bit 15, as shown in FIG. 3, for threaded engagement with the pin connection 42 at the lower end of the downhole bit motor 14. The preferred interconnection between the motor and the bit is thus made through a pin connection on the motor and the box connection on the bit. For the FIG. 1 embodiment, the BHA is not used for directional drilling operations, and accordingly the motor 14 does not have a bend in the motor housing. The motor is, however, powered to rotate the bit, or the drill string itself is generally slid in the well, but also may be rotated while the motor is powering the bit. The BHA 10 as shown in FIG. 1 may thus be used for substantially straight drilling operations, with the benefits discussed above.

A BHA 10 with a bend as shown in FIG. 2 is preferable for many applications, since it may be desirable or necessary to drill portions of the wellbore at a deviation angle determined by the bend in the motor. In other operations, portions of the wellbore or the entire wellbore may be drilled "straight," with relatively little concern to inclination. In those applications, a PDM 14 may be provided without a bend, and the borehole drilled straight.

Figure 4:
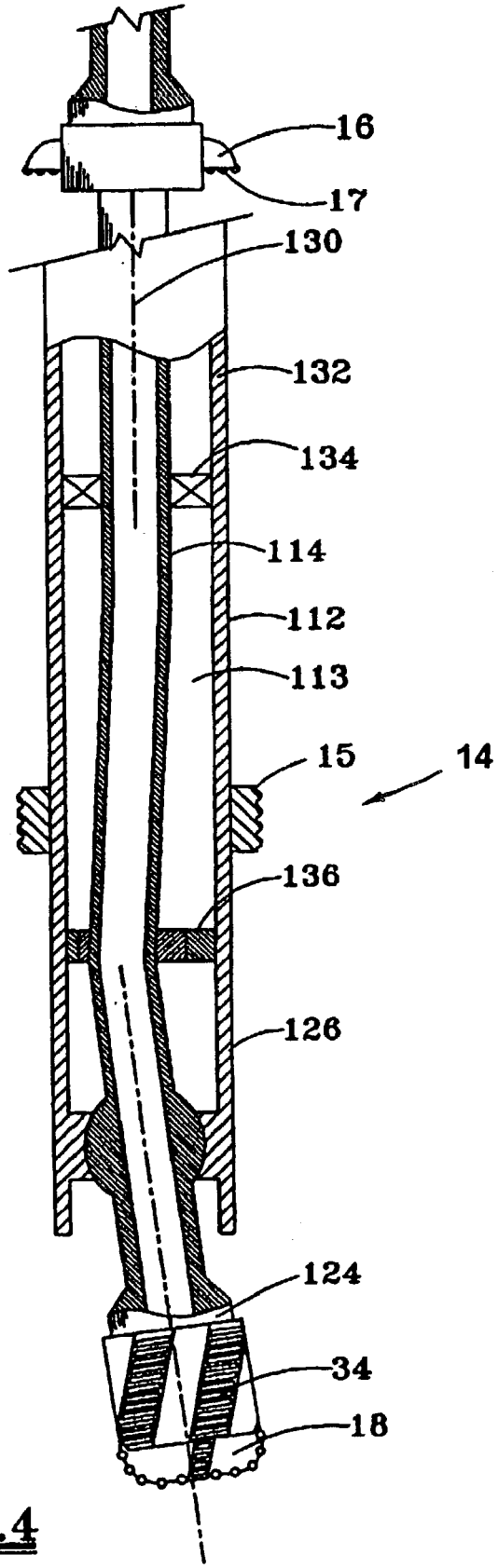
FIG. 4 illustrates a rotary steerable assembly showing an internal bend.

FIG. 4 illustrates the downhole motor 14 which is a rotary steerable assembly (RSA) with a generally cylindrical housing 112 with no housing bend, although a lower axis 124 of the lower portion of shaft 114 which is within lower housing section 126 is angled at an effective bend angle from the central axis 130 of the upper guide section 132 of the RSA. The bearing 134 guides rotation of shaft 114 and conventionally seals with housing 112, while bend inducer 136 provides the effective bend angle. The RSA includes a rotation prevention device 15, which engages the borehole wall and prevents or minimizes rotation of the housing 112 while the shaft 114 within is being rotated, and provides a non-rotating reference from which the bend inducer 136 can angle the rotating shaft in order to directionally drill. The outer diameter of the bend inducer 136 therefore is preferably the same diameter or slightly smaller diameter than the bit cutting diameter which is below the RSA. In one embodiment the bit may be a pilot bit 18. In another embodiment, when a hole diameter larger than the tubular above is desired, a reamer may additionally be employed. For an RSA with a reamer 16 with a cutting diameter greater than the diameter of the pilot bit 18, the reamer 16 is preferably provided above the RSA, while the pilot bit 18 and gauge section 34 are provided below the RSA.

The RSA may include a continuous, hollow, rotating shaft which is radially deflected by a double eccentric ring cam unit which is an example of bend inducer 136 which causes the lower end of the shaft to pivot about a spherical bearing system. The intersection of the central axis of the housing 132 and the central axis 124 of the pivoted shaft below the spherical bearing system defines the bend (with respect to the substantially non-rotating outer housing 112) for directional drilling purposes. To drill straight, the double eccentric cams are arranged so that the deflection of the shaft is relieved and the central axis of the shaft below the spherical bearing system is put in line with the central axis of the housing 132. The bend angle provides a bit tool face orientation with respect to the housing 112, which itself is referenced to the borehole, enabling steering analogous to the steering performed with a bent housing PDM.

A bearing 134 is shown above the bend inducer unit 136 for guiding or centralizing the upper shaft 114 in housing 112. The annulus 113 between shaft 114 and the housing 112 and below the bearing 134 will typically be filled with lubricating oil. Shaft deflection may be achieved by a double eccentric ring cam example of bend inducer 136 such as disclosed in U.S. Pat. Nos. 5,307,884 and 5,307,885. Those skilled in the art will appreciate that the RSA is simplistically shown in FIG. 4, and that the actual RSA is much more complex than depicted in FIG. 4.

As with the PDM, the axial spacing along the central axis of the lower portion of the rotating shaft between the bend and the pilot bit face for the RSA application could be as much as ten times the bit diameter to obtain the primary benefits of the present invention. In a preferred embodiment, the bend to pilot bit face spacing is from four to eight times, and typically approximately five times the pilot bit diameter. This reduction of the bend to pilot bit face distance means that the RSA can be run with less bend angle than the PDM to achieve the same build rate. Because the RSA has a short bend to pilot bit face length and is similar to the PDM in terms of directional control while steering, the primary benefits of the present invention are expected to apply while steering with the RSA when run with a long gauge pilot bit having a total gauge length of at least 75% of the pilot bit diameter and preferably at least 90% of the pilot bit diameter and at least 50% of the total gauge length is substantially full gauge, and then running and expanding casing.

When the downhole motor is powered to rotate the bit and drill a deviated portion of the well, desirably high rates of penetration often may be achieved by rotating the bit at less the 350 RPM. Reduced vibrations result from the use of a long gauge above the pilot bit face and the relatively short length between the bend and the pilot bit, thereby increasing the stiffness of the lower bearing section. The benefits of improved borehole quality include reduced hole cleaning expense, improved logging operations and log quality, easier casing runs and more reliable cementing operations. The BHA has low vibration, which again contributes to improved borehole quality.

The BHA of the present invention is able to drill a hole utilizing less weight on bit and thus less torque than prior art BHAs, and is able to drill a "truer" hole with less spiraling. The forces required to rotate the bit to penetrate the formation at a desired drilling rate may be lowered according to this invention, so that less force may be transmitted along the drill string to the bit. The operator has more flexibility with respect to the weight on bit to be applied at the surface through the drill string. Since the drilled hole is truer, there is less drag on the tubular string inserted in the borehole for being subsequently expanded.

An improved method of securing an expanded tubular in a wellbore utilizing the bottom hole assembly of this invention thus preferably involves drilling a portion of the wellbore with the downhole motor to rotate the bit, which may result in a directionally drilled wellbore as discussed above and/or may include a straight section of the well. After a section of the borehole is drilled, a tubular is inserted at the desired depth within the wellbore, the solid downhole tubular is expanded so that plastic deformation results in a diameter substantially greater than its run-in diameter, and in many applications to a plastically deformed internal diameter substantially equal to an internal diameter of the upper tubular secured in the wellbore. According to the present invention, a tubular string, such as a casing string, may be inserted into the drilled borehole and subsequently expanded to a diameter approximating the internal diameter of an upper tubular, such as a cemented in place casing string, through which the inserted tubular is passed.

The tubular is thus expanded in an open hole application, and accordingly the tubular may be expanded into engagement with the formation wall. The axial length of continuous tubular which is expanded is relatively long, i.e., in excess of 50 times the original, run-in or pre-expansion diameter of the tubular, and typically one hundred times or more the pre-expansion diameter of the expanded tubular. The term "expanded tubular" thus includes casing and liner systems. The expanded tubular is also commonly cemented in the well. According to the present invention, the cementing operation may be performed after, but also before expanding the downhole tubular. Expansion prior to cementing is safe, since a failed expansion operation is not then cemented in the well. With increasingly slow setting cement, the advantages of cementing and then expanding may be considered since the expanding operation according to the invention is highly reliable.

A significant feature of the invention is that the tubular which is expanded downhole may have a larger initial diameter than a prior art tubular which was expanded downhole to the same diameter according to the prior art, therefore utilizing less of an expansion rate and reducing the likelihood of expanding the downhole tubular, and particularly the bottom bell section of an upper tubular, beyond the rated tubular strength. This technique further results in substantially increased flexibility to the operator in terms of the availability of tubulars which may be used downhole in expansion operations, thereby reducing the cost of the tubulars.

In some applications, the expanded tubular may be part of a multi-lateral system, including a system wherein the branch is full bore, i.e., the same diameter as the central bore. In other applications, the expanded tubular may be casing used in a casing drilling operation. In many applications, the expanded tubular will engage the formation wall along at least a portion of its length and at one or more circumferentially spaced contact locations. Since a truer borehole may be drilled with the BHA of the present invention, the drilled borehole diameter may be reduced, resulting in less cut rock to complete the well and/or a larger size tubular in the drilled borehole, and possibly a larger size expanded tubular.

In some applications, the run-in tubular may be passed through an existing upper tubular secured in the wellbore, and that upper tubular in turn may have been expanded downhole. To interconnect the tubulars, the top of the run-in tubular is conventionally positioned slightly above the bottom of the upper tubular already secured in the wellbore, then the run-in tubular is expanded to an internal diameter substantially equal to the internal diameter of the upper tubular. The bottom of the upper tubular has a bell portion and is twice expanded, first from its run-in diameter to its expanded diameter, and second when the overlapping run-in tubular is expanded. By reducing the amount of expansion required to complete the well, high stress areas such as the bell portion of the upper tubular may be more safely expanded. Less expansion also allows for the use of less expensive materials for the expanded tubular, which in a single well may save hundreds of thousands of dollars.

In many applications, the downhole tubular once expanded has an internal diameter (ID) substantially equal to the internal diameter of an upper tubular spaced in the well above the expanded tubular. In other cases, the internal diameter of the expanded tubular may be less than the internal diameter of the upper tubular in the well. In still other applications, however, the internal diameter of the expanded tubular may be greater than the internal diameter of the upper tubular in the well, and the upper tubular itself may optionally be expanded downhole. Expanding a downhole tubular to a diameter greater than the diameter of the upper tubular in the well may be desired to achieve increased mechanical bonding between the expanded tubular and either another tubular or the formation walls. Expansion beyond the internal diameter of the upper tubular may also allow a sleeve (for example, a sliding sleeve for production control) to be placed in the expanded tubular, with the internal diameter of the sleeve approximating the full bore of the upper tubular. In other applications, expanding the downhole tubular to a diameter larger than the upper tubular in the well may allow installing a level 6 multi-lateral junction system. The unction preferably is larger than the upper tubular to accommodate multiple full bore liners. In still other applications, expanding the downhole tubular to a diameter larger than the upper tubular in the well may allow a relatively large diameter tool to be positioned in the expanded downward tubular, with sufficient flow bypass area between the tool and the wall of the expanded tubular to allow good fluid circulation while conducting a test.

A primary advantage of the present invention is that it allows drilling operations to be conducted more economically, and with a lower risk of failure. The truer hole produced with this BHA not only results in lower torque and drag in the well, but the relatively smooth wellbore resulting from the BHA of this invention provides for better cementing and hole cleaning. The BHA not only results in reduced costs to run the tubular in the well which is to be expanded, but also results in better ROP, better steerability, improved reamer reliability, and reduced drilling costs.

Tables 1 and 2 illustrate the possible size increase for common casing sizes. The "yield" column refers to the internal pressure (psi) at which the tubular will begin to yield. When used in the well, this would commonly be the internal to external pressure differential. The "collapse" column refers to the external pressure (or differential when in the well) at which the tubular will collapse. The term "common casing" refers to casing above the newly drilled hole in which the expandable will be used, i.e., the casing through which the expandable casing must be run. In the table, these are API standard tubular, although similar examples could be used for a casing string which itself was expanded to similar common casing dimensions. From an operational standpoint, the operator first determines the casing size, and then chooses the associated SET tubulars to run through the casing for subsequent expansion. According to the present invention, the operator also starts with this common casing, but preferably chooses SET tubulars of larger pre-expansion diameters, enabling a lesser expansion ratio to accomplish the desired result with the attendant advantages.

TABLE 2-continued

| COMMON CASING | | | | IMPROVED EXPANDABLE TECHNOLOGY | | | |
|---|---|---|---|---|---|---|---|
| | | | | Pre-expansion | | Post-Expansion | |
| OD (In) | Wt (lb/ft) | ID (in) | Drift (In) | OD (In) | ID (In) | ID (In) | Expan ratio |
| 9.625 | 43.5 | 8.755 | 8.599 | 8.5 | 7.75 | 7.92 | 2.19% |
| 7 | 26 | 6.276 | 6.151 | 6 | 5.392 | 5.57 | 3.30% |
| 5.5 | 17 | 4.892 | 4.767 | 4.625 | 4.125 | 4.287 | 3.93% |

In order to perform the downhole expansion, the launcher/mandrel of an expansion tool and a liner may be passed through an upper casing so their ODs are limited by the drift of the upper casing. E.g., 16" 95 lb/ft API casing has an ID of 14.868" and a drift of 14.680". The launcher OD is 14.570" but the pre-expansion liner OD is only 13.375". The present invention may reduce the expansion ratio from about 10% to 12% to about 4% or less. The post-expansion liner OD and ID may stay the same, since the ID is determined by the mandrel size. The wall thickness should not change as a function of a larger liner size; both shrink by about 4% after expansion.

Reduced expansion has several benefits, including significantly less reduction in post-expansion yield and collapse strengths. Reduced expansion has several benefits, including a reduction of the material strength losses associated with expansion. In particular, the prior art expansion process causes the collapse pressure (in an external pressure condition) to be degraded by about 50%, as can be seen in Table 1. The lesser expansion associated with this invention provides an increased collapse pressure capability as compared to the prior art. Further, the improved mechanical properties of the expandable liner or casing may allow use not only as drilling liners, but also as production liners which require increased pressure capability. Another advantage is the

TABLE 1

| COMMON CASING | | | | CONVENTIONAL EXPANDABLE TECHNOLOGY | | | | | | | | |
|---|---|---|---|---|---|---|---|---|---|---|---|---|
| | | | | Pre-expansion | | | | Post-expansion | | | | |
| OD (In) | Wt (lb/ft) | ID (in) | Drift (In) | OD (In) | ID (In) | Yield (psi) | Collapse (psi) | OD (In) | ID (In) | Yield (psi) | Collapse (psi) | Expan ratio |
| 16 | 95 | 14.868 | 14.68 | 13.375 | 12.615 | 3978 | 1140 | 14.759 | 14.028 | 3440 | 600 | 11.20% |
| 11.75 | 60 | 10.772 | 10.616 | 9.625 | 8.921 | 5120 | 2370 | 10.657 | 9.98 | 4430 | 1270 | 11.80% |
| 9.625 | 43.5 | 8.755 | 8.599 | 7.625 | 6.875 | 6885 | 4790 | 8.63 | 7.92 | 5760 | 2480 | 15.20% |
| 7 | 26 | 6.276 | 6.151 | 5.5 | 4.892 | 7738 | 6285 | 6.148 | 5.57 | 6580 | 3400 | 13.90% |
| 5.5 | 17 | 4.892 | 4.767 | 4.25 | 3.75 | 8235 | 7150 | 4.761 | 4.287 | 6960 | 3940 | 14.30% |

TABLE 2

| COMMON CASING | | | | IMPROVED EXPANDABLE TECHNOLOGY | | | |
|---|---|---|---|---|---|---|---|
| | | | | Pre-expansion | | Post-Expansion | |
| OD (In) | Wt (lb/ft) | ID (in) | Drift (In) | OD (In) | ID (In) | ID (In) | Expan ratio |
| 16 | 95 | 14.868 | 14.68 | 14.5 | 13.74 | 14.028 | 2.10% |
| 11.75 | 60 | 10.772 | 10.616 | 10.5 | 9.796 | 9.98 | 1.88% |

reduction of the pull/push forces required to expand the tubular downhole. Reduction of the degree of expansion also allows for the reduction of the mechanical complexity of the retractable mandrel.

The present invention may be used with SET expandable open hole liners, including a mandrel/cone system and a rotary compliant expansion system. The former uses high pressure and high pull force, while the latter primarily employs the mechanical push force to expand the liner. The high pressure used in the mandrel/cone technique serves two purposes: to help the pull force, and to keep the liner on the bottom. Accordingly, the former technique may be more efficient than the rotary compliant system.

Table 3 illustrates the expansion ratios utilizing conventional technology. The lowest expansion ratio is 7.7%, but the average ratio is approximately 12%. The present invention allows a ratio to be reduced to less than about 6%, and in most cases less than about 4%. Reduced expansion significantly lowers the internal expansion pressure requirement compared to tubulars expanded 12% or more. Reduced expansion also allows for use of more conventional tubulars fabricated from less expensive materials and/or manufactured according to less expensive techniques. According to the present invention, the benefits of the downhole expansion are achieved, but the standard tubular retains a high collapse and burst strength.

TABLE 3

| COMMON CASING, In | WEIGHT, Lb/ft | EXPANSION RATIO, % |
|---|---|---|
| 5.5 | 14 | 16 |
| 5.5 | 15.5 | 16 |
| 5.5 | 17 | 14.3 |
| 5.5 | 20 | 9.7 |
| 5.5 | 23 | 7.7 |
| 7 | 20 | 16.1 |
| 7 | 23 | 16.1 |
| 7 | 26 | 13.9 |
| 7 | 29 | 11.1 |
| 7.625 | 29.7 | 14.8 |
| 7.625 | 33.7 | 12.8 |
| 7.625 | 39 | 9.8 |
| 7.625 | 47.1 | 12.4 |
| 9.625 | 47 | 13.9 |
| 9.625 | 53.5 | 11.6 |
| 9.875 | 62.8 | 13 |
| 11.75 | 60 | 11.8 |
| 11.75 | 65 | 11.8 |
| 16 | 75 | 13.2 |
| 16 | 84 | 12.3 |
| 16 | 95 | 11.2 |
| 16 | 97 | 11.1 |

Figure 5:
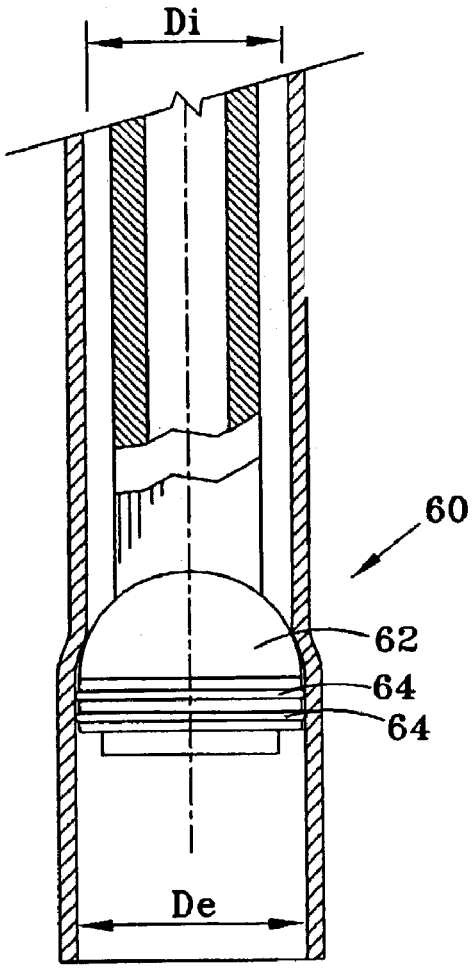
FIG. 5 illustrates one type of expansion tool for expanding a downhole tubular within a wellbore.

FIG. 5 illustrates one type of an expansion tool 60 suitable for expanding a downhole tubular according to the present invention. Tool 60 expands the casing from the initial diameter, Di, to a tubular expanded diameter, De, using expansion element 62 which results in a predetermined expansion of the casing. Seal rings 64 seal with the ID of the expanded casing.

Figure 6:
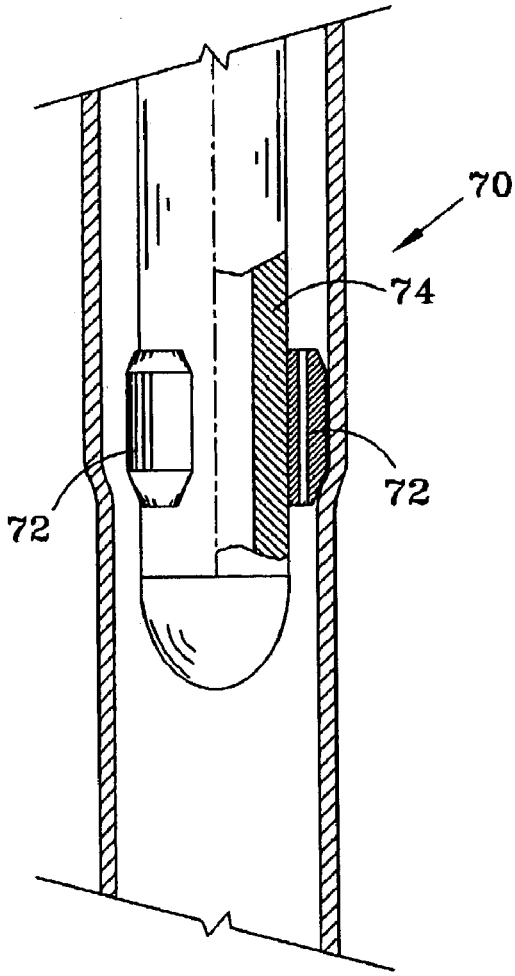
FIG. 6 illustrates an alternative type of expansion tool.

FIG. 6 illustrates alternative expansion tool 70 which uses a plurality of rollers 72 to expand the tubular. Each of these rollers 72 thus rotate about tool mandrel 74. The amount of expansion may depend on the resistance to expansion, if any, provided by the formation and/or an outer tubular engaged by the expanding tubular, since the axis of rotation for each roller may move radially relative to the expansion tool centerline.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

The invention claimed is:

1. A method of positioning a solid tubular in a borehole utilizing a bottom hole assembly including a downhole motor having an upper section with an upper central axis and a lower bearing section with a lower bearing central axis offset at a selected bend angle from the upper section central axis by a bend, the bottom hole assembly further including a bit assembly including a bit, the method comprising:

securing a gauge section above the bit, the gauge section having a uniform diameter cylindrical bearing surface thereon along an axial length of at least about 60% of a cutting diameter of the bit;

rotating the bit and the gauge section to drill the borehole by one of pumping fluid through the downhole motor and rotating the drill string from the surface while passing fluid through the downhole motor;

inserting a first tubular with a run-in internal diameter at a desired depth within the drilled borehole;

expanding the first tubular within the drilled borehole to an expanded internal diameter less than about 6% greater than the first tubular run-in internal diameter;

inserting a second tubular with a run-in internal diameter less than the run-in internal diameter of the first tubular at a desired depth within the drilled borehole; and expanding the second tubular within the drilled borehole to an expanded diameter less than about 6% greater than the second tubular run-in internal diameter.

2. A method as defined in claim 1, wherein expanding the first tubular to the expanded internal diameter fixes the first tubular in the well.

3. A method as defined in claim 1, wherein the second tubular is expanded to engage an internal surface of a lower end of the first tubular.

4. A method as defined in claim 3, wherein the lower end of the first tubular is expanded to form a bell having an internal diametergreater than the internal diameter of the second tubular.

5. A method as defined in claim 1, wherein the gauge section has an axial length of at least 75% of the bit cutting diameter.

6. A method as defined in claim 1, wherein one or more portions of the gauge section bearing surface having a full gauge diameter are provided along at least about 50% of the axial length of the gauge section.

7. A method as defined in claim 1, further comprising:

securing a reamer for rotation with the gauge section to form the bit assembly.

8. A method as defined in claim 1, further comprising:

securing an offset cutting element of a bi-centered bit for rotation with the gauge section to form the bit assembly.

9. A method as defined in claim 1, further comprising:

providing a pin connection at a lower end of the downhole motor; and providing a box connection at an upper end of the bit assembly for mating interconnection with the pin connection.

10. A method as defined in claim 1, wherein the expanded first tubular has an expanded internal diameter substantially equal to the internal diameter of an upper tubular in the well above the expanded tubular.

11. A method as defined in claim 1, wherein the expanded first tubular has an expanded internal diameter greater than the internal diameter of an upper tubular in the well above the expanded tubular.

12. A method as defined in claim 1, wherein the expanded first tubular has an expanded internal diameter less than the internal diameter of an upper tubular in the well above the expanded tubular.

13. A method as defined in claim 1, further comprising:

cementing the expanded first tubular in the wellbore.

14. A method as defined in claim 13, wherein an annulus about the first tubular is filled with cement prior to expanding the first tubular.

15. A method as defined in claim 1, wherein an axial length of the first tubular which is expanded is at least 50 times a pre-expansion diameter of the tubular.

16. A method as defined in claim 1, wherein the downhole motor is one of a positive displacement motor and a rotary steerable assembly.

17. A method as defined in claim 1, wherein the downhole motor in the bottom hole assembly is a positive displacement motor.

18. A method as defined in claim 1, wherein the downhole motor in the bottom hole assembly is a rotary steerable assembly.

19. A method of positioning a solid tubular in a borehole utilizing a bottom hole assembly including a downhole motor having an upper section with an upper section central axis and a lower bearing section with a lower bearing central axis, the bottom hole assembly further including a bit assembly including a bit, the method comprising:

securing a gauge section above a cutting diameter of the bit, the gauge section having a uniform diameter bearing surface thereon along an axial length of at least about 60% of the bit cutting diameter;

rotating the bit and the gauge section to drill the borehole;

inserting a tubular with a run-in internal diameter at a desired depth within the drilled borehole; and expanding the downhole tubular less than about 6% greater than the run-in internal diameter and to less than about 10 inches internal diameter to engage at least one of a lower end of an upper tubular secured in the borehole and the borehole wall, thereby securing the expanded tubular in the borehole.

20. A method as defined in claim 19, wherein the gauge section has an axial length of at least 75% of the bit diameter.

21. A method as defined in claim 19, further comprising: wherein an expanded internal diameter of the tubular is substantially equal to an internal diameter of the upper tubular in the wellbore above the downhole tubular.

22. A method as defined in claim 19, wherein the expanded downhole tubular has an expanded internal diameter greater than the internal diameter of the upper tubular in the well above the expanded tubular.

23. A method as defined in claim 19, wherein the expanded downhole tubular has an expanded internal diameter less than the internal diameter of the upper tubular in the well above the expanded tubular.

24. A method as defined in claim 19, further comprising:

providing a pin connection at a lower end of the downhole motor; and providing a box connection at an upper end of the bit assembly for mating interconnection with the pin connection.

25. A method as defined in claim 19, further comprising: cementing the downhole tubular in the wellbore.

26. A method as defined in claim 25, wherein an annulus about the tubular is filled with cement prior to expanding the downhole tubular.

27. A method as in claim 19, wherein the downhole motor is one of a positive displacement motor and a rotary steerable assembly.

28. A method as defined in claim 19, further comprising:

securing one of a reamer and an offset cutting element of a bi-center bit for rotation with the gauge section to form the bit assembly.

29. A method as defined in claim 19, wherein the downhole motor in the bottom hole assembly is a positive displacement motor.

30. A method as defined in claim 19, wherein the downhole motor in the bottom hole assembly is a rotary steerable assembly.

31. An assembly for securing an expanded tubular in a borehole utilizing a bottom hole assembly including a downhole motor having an upper power section with an upper section central axis and a lower bearing section with a lower bearing central axis, the bottom hole assembly further including a bit assembly having a bit cutting diameter, the assembly further comprising:

a gauge section secured above the bit, the gauge section having a substantially uniform diameter rotating bearing surface thereon along an axial length of at least about 60% of the bit cutting diameter;

a tubular with a run-in internal diameter inserted at a desired depth within the drilled borehole and then expanded downhole to a final expanded diameter greater than the run-in internal diameter; and an expansion tool for expanding at least a portion of the tubular to the final expanded internal diameter less than about 6% greater than the run-in internal diameter and to less than about 10 inches internal diameter.

32. An assembly as defined in claim 31, wherein the gauge section has an axial length of at least 75% of the bit cutting diameter.

33. An assembly as defined in claim 31, wherein a portion of the gauge section which has the substantially uniform diameter rotating bearing surface is no less than about 50% of the axial length of the gauge section.

34. An assembly as defined in claim 31, wherein the expanded internal diameter of the tubular is substantially equal to an internal diameter of an upper tubular in the wellbore above the expanded tubular.

35. An assembly as defined in claim 31, comprising:

the lower bearing central axis offset at a selected bend angle from the power section central axis by a bend; and the bend being spaced from the bit face less than fifteen times the bit cutting diameter.

36. An assembly as defined in claim 31, wherein the expanded tubular has an internal diameter substantially equal to the internal diameter of an upper tubular in the well above the expanded tubular.

37. An assembly as defined in claim 31, wherein the expanded tubular has an expanded internal diameter greater than the internal diameter of an upper tubular in the well above the expanded tubular.

38. An assembly as defined in claim 31, wherein the expanded tubular has an expanded internal diameter less than the internal diameter of an upper tubular in the well above the expanded tubular.

39. An assembly as defined in claim 31, further comprising:

a reamer above the gauge section to form the bit assembly.

40. An assembly as defined in claim 31, further comprising:

an offset cutting element of a bi-centered bit above the gauge section to form the bit assembly.

41. An assembly as defined in claim 31, wherein the downhole motor is a positive displacement motor.

42. An assembly as defined in claim 31, wherein the downhole motor is a rotary steerable assembly.

43. An assembly as defined in claim 31, wherein the expansion tool expands another portion of a downhole tubular to a final expanded internal diameter less than 6% greater than the run-in internal diameter of the another portion of the tubular.

44. A method of positioning a solid tubular in a borehole utilizing a bottom hole assembly including a downhole motor having an upper section with an upper central axis and a lower bearing section with a lower bearing central axis offset at a selected bend angle from the upper section central axis by a bend, the bottom hole assembly further including a bit assembly rotatable by the motor and including a bit having a bit cutting diameter, the method comprising:

securing a gauge section above a bit face defining the bit cutting diameter, the gauge section having a substantially uniform diameter rotating bearing surface thereon along an axial length of at least about 60% of a bit cutting diameter;

rotating the bit and the gauge section by pumping fluid through the downhole motor to drill the borehole;

inserting a tubular with a run-in internal diameter at a desired depth within the drilled borehole;

expanding the downhole tubular to an expanded tubular having an expansion ratio of about 6% or less and to less than about 10 inches internal diameter; and cementing the down hole tubular in the well bore.

45. A method as defined in claim 44, further comprising: pumping cement about the downhole tubular in the wellbore before expanding the downhole tubular.

46. A method as defined in claim 44, wherein an axial length of the downhole tubular which is expanded is at least 50 times a pre-expansion diameter of the tubular.

47. A method as defined in claim 44, wherein expanding the downhole tubular to the expanded internal diameter secures the downhole tubular in the well.

48. A method as defined in claim 44, wherein the downhole tubular is expanded to engage an internal surface of a lower end of an upper tubular.

49. A method as defined in claim 44, wherein the lower end of the upper tubular is expanded to form a bell having an internal diameter greater than the internal diameter of the upper tubular.

50. A method as defined in claim 44, wherein the gauge section has an axial length of at least 75% of the bit diameter.

51. A method as defined in claim 44, further comprising:

providing a pin connection at a lower end of the downhole motor; and providing a box connection at an upper end of the bit assembly for mating interconnection with the pin connection.

52. A method as defined in claim 44, wherein the expanded downhole tubular has an internal diameter substantially equal to the internal diameter of an upper tubular in the well above the expanded tubular.

53. A method as defined in claim 44, wherein the expanded downhole tubular has an internal expanded diameter greater than the internal diameter of an upper tubular in the well above the expanded tubular.

54. A method as defined in claim 44, wherein the expanded downhole tubular has an internal expanded diameter less than the internal diameter of an upper tubular in the well above the expanded tubular.

55. A method as defined in claim 44, wherein the downhole tubular expansion ratio is less than about 4%.

56. A method as defined in claim 44, wherein the downhole motor is a positive displacement motor.

57. A method as defined in claim 44, further comprising: securing an offset cutting element of a reamer for rotation with the gauge section to form the bit assembly.

58. A method as defined in claim 44, further comprising: securing a bi-centered bit for rotation with the gauge section to form the bit assembly.

59. A method as defined in claim 44, wherein the downhole motor in the bottom hole assembly is a rotary steerable assembly.

60. A method of positioning a solid tubular in a borehole utilizing a bottom hole assembly including a downhole motor having an upper section with an upper section central axis and a lower bearing section with a lower bearing central axis, the bottom hole assembly further including a bit assembly including a bit defining a bit cutting diameter, the method comprising:

securing a gauge section above a bit face defining the bit cutting diameter, the gauge section having a uniform diameter bearing surface thereon along an axial length of at least about 60% of the bit cutting diameter;

rotating the bit and the gauge section;

inserting a tubular with a run-in internal diameter at a desired depth within the drilled borehole; and expanding the downhole tubular about 6% or less and to less than about 10 inches internal diameter to engage at least one of a lower end of an upper tubular secured in the borehole and the borehole wall, thereby securing the expanded tubular in the borehole.

61. A method as defined in claim 60, wherein the gauge section has an axial length of at least 75% of the bit diameter.

62. A method as defined in claim 60, further comprising:

providing a pin connection at a lower end of the downhole motor; and providing a box connection at an upper end of the bit assembly for mating interconnection with the pin connection.

63. A method as defined in claim 60, wherein the expanded downhole tubular has an expanded internal diameter substantially equal to the internal diameter of an upper tubular in the well above the expanded tubular.

64. A method as defined in claim 60, wherein the expanded downhole tubular has an expanded internal diameter greater than the internal diameter of an upper tubular in the well above the expanded tubular.

65. A method as defined in claim 60, wherein the expanded downhole tubular has an expanded internal diameter less than the internal diameter of an upper tubular in the well above the expanded tubular.

66. A method as defined in claim 60, further comprising: cementing the downhole tubular in the wellbore.

67. A method as defined in claim 66, further comprising: pumping cement about the expanded tubular in the wellbore before expanding the downhole tubular.

68. A method as defined in claim 60, wherein an axial length of the downhole tubular which is expanded is at least 50 times a pre-expansion diameter of the tubular.

69. A method as defined in claim 60, further comprising: securing a reamer for rotation with the gauge section to form the bit assembly.

70. A method as defined in claim 60, further comprising: securing an offset cutting element of a bi-centered bit for rotation with the gauge section to form the bit assembly.

71. A method as defined in claim 60, wherein the downhole motor is one of a positive displacement motor and a rotary steerable assembly.

72. A method as defined in claim 60, wherein the downhole motor in the bottom hole assembly is a positive displacement motor.

73. A method as defined in claim 60, wherein the downhole motor in the bottom hole assembly is a rotary steerable assembly.

* * * * *

UNITED STATES PATENT AND TRADEMARK OFFICE

CERTIFICATE OF CORRECTION

PATENT NO. : 7,213,643 B2
APPLICATION NO. : 10/421135
DATED : May 8, 2007
INVENTOR(S) : Chen-Kang D. Chen, Daniel D. Gleitman and M. Vikram Rao It is certified that error appears in the above-identified patent and that said Letters Patent is hereby corrected as shown below:

In column 15, line 37, claim 49, line 1, delete "44" and insert therefor --48--.

Signed and Sealed this

Thirtieth Day of September, 2008

JON W. DUDAS
*Director of the United States Patent and Trademark Office*